US010786103B2

(12) United States Patent
Teoh

(10) Patent No.: US 10,786,103 B2
(45) Date of Patent: Sep. 29, 2020

(54) COLLAPSIBLE SECURED PARCEL DROP BOX

(71) Applicant: Soo Teoh, Mill Creek, WA (US)

(72) Inventor: Soo Teoh, Mill Creek, WA (US)

( * ) Notice: Subject to any disclaimer, the term of this patent is extended or adjusted under 35 U.S.C. 154(b) by 140 days.

(21) Appl. No.: 15/955,245

(22) Filed: Apr. 17, 2018

(65) Prior Publication Data

US 2018/0296016 A1 Oct. 18, 2018

Related U.S. Application Data

(60) Provisional application No. 62/486,637, filed on Apr. 18, 2017.

(51) Int. Cl.
*A47G 29/20* (2006.01)
*A47G 29/14* (2006.01)

(52) U.S. Cl.
CPC ..... *A47G 29/20* (2013.01); *A47G 29/141* (2013.01); *A47G 2029/144* (2013.01)

(58) Field of Classification Search
CPC ..... A47G 29/20; A47G 29/141; A47G 29/14; A47G 29/1216; A47G 29/124; A47G 29/16; A47G 2029/144; A47G 2029/148; E05G 1/005; E05G 1/024; E05G 1/04; B65D 7/26; B65D 55/14; E05C 19/003; E05B 65/0075; E05B 59/00; E05B 19/0005
USPC .... 232/1 E, 19, 45, 38, 39; 70/63, 101, 107, 70/114, 160; 220/6; 109/50
See application file for complete search history.

(56) References Cited

U.S. PATENT DOCUMENTS

| | | | | | |
|---|---|---|---|---|---|
| 1,673,769 | A * | 6/1928 | Graham | G07C 13/02 | 220/6 |
| 4,694,668 | A * | 9/1987 | Ciletti | A47G 29/20 | 109/50 |
| 4,909,052 | A * | 3/1990 | Hutwohl | A47G 29/20 | 109/50 |
| 5,027,948 | A * | 7/1991 | Forbes | G11B 23/023 | 206/387.11 |
| 5,624,071 | A * | 4/1997 | Sosan | A47G 29/20 | 232/1 B |
| 6,155,715 | A * | 12/2000 | Lake | A47G 29/20 | 150/102 |
| 6,330,816 | B1 * | 12/2001 | O'Connor | E05B 19/0005 | 109/50 |
| D644,814 | S * | 9/2011 | Clarke | D99/33 | |
| 9,596,952 | B2 * | 3/2017 | Mencel | A47G 29/20 | |
| 10,143,321 | B2 * | 12/2018 | Hippert | A47G 29/20 | |
| 10,321,780 | B1 * | 6/2019 | James | A47G 29/16 | |
| 10,383,471 | B1 * | 8/2019 | Barnes | A47G 29/16 | |
| 10,512,352 | B1 * | 12/2019 | Torres | A47G 29/22 | |

(Continued)

*Primary Examiner* — William L Miller
(74) *Attorney, Agent, or Firm* — Carlson, Gaskey & Olds, P.C.

(57) ABSTRACT

An example collapsible secured parcel drop box is disclosed and includes a plurality of side panels defining an interior space, a back panel secured to the side panels, a lid movable between open and closed positions over the interior space and a lock assembly disposed on the lid for locking the lid in position to prevent opening of the lid. The disclosed example drop box also includes a bracket temporarily securing the parcel drop box to a fixed structure and an anti-rotation bracket to maintain a fixed position of the drop box relative to the fixed structure. The drop box collapsible for storage and removable from the door when not required.

3 Claims, 15 Drawing Sheets

(56) References Cited

U.S. PATENT DOCUMENTS

| | | | | |
|---|---|---|---|---|
| 10,537,196 | B1 * | 1/2020 | MacPherson | A47G 29/141 |
| 10,537,197 | B2 * | 1/2020 | Hopp | A47G 29/20 |
| 2005/0193931 | A1 * | 9/2005 | Boudreau | E05B 65/0075 109/50 |
| 2016/0051073 | A1 * | 2/2016 | Heinz | A47G 29/141 232/39 |
| 2016/0068306 | A1 * | 3/2016 | Heinz | B65D 21/086 220/560.01 |
| 2016/0309939 | A1 * | 10/2016 | Mencel | A47G 29/20 |
| 2017/0127868 | A1 * | 5/2017 | Adewuyi | A47G 29/141 |
| 2017/0188737 | A1 * | 7/2017 | Hippert | A47G 29/20 |
| 2019/0256119 | A1 * | 8/2019 | Brilhante | B62B 5/0495 |
| 2019/0350398 | A1 * | 11/2019 | Raphael | A47G 29/141 |

* cited by examiner

40

22
24

26
22

14
PARCEL
DROP
BOX
28

20
BOX
UNLOCK
LOCK
45
38
38
45

COLLAPSIBLE SECURED PARCEL DROP BOX

CROSS REFERENCE TO RELATED APPLICATION

This application claims priority to U.S. Provisional Application Ser. No. 62/486,637 filed on Apr. 18, 2017.

BACKGROUND

Increasingly, consumers are ordering items through online marketplaces. The items ordered may be inexpensive items, but may also include expensive items or items containing personal information. In many instances the ordered items arrive in packages and are simply placed against an exterior door. Smaller packages may be placed in a mailbox. However, in either case, the packages are left unsecured. In some instances, someone must be home to personally receive the package. However, this can be inconvenient and result in undesired delays in receiving the package.

Lock boxes that are permanently mounted to a building or other fixed object are known and used in commercial settings. However, most of the time such a permanently mounted lock box is unused and an obstruction. Moreover, some residences may not have room for a permanent lock box, or may simply not be permitted to have a permanent lock box. For example, apartment complexes and planned communities may have strict control on placement and the appearance of items permanently mounted in public areas.

SUMMARY

An example collapsible secured parcel drop box according to one non-limiting example embodiment includes, among other possible things, a plurality of side panels defining an interior space, a back panel secured to the side panels, a lid movable between open and closed positions over the interior space and a lock assembly disposed on the lid for locking the lid in position to prevent opening of the lid. The disclosed example drop box also includes a bracket temporarily securing the parcel drop box to a fixed structure and an anti-rotation bracket to maintain a fixed position of the drop box relative to the fixed structure. The drop box is collapsible for storage and removable from the door when not required.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 2:
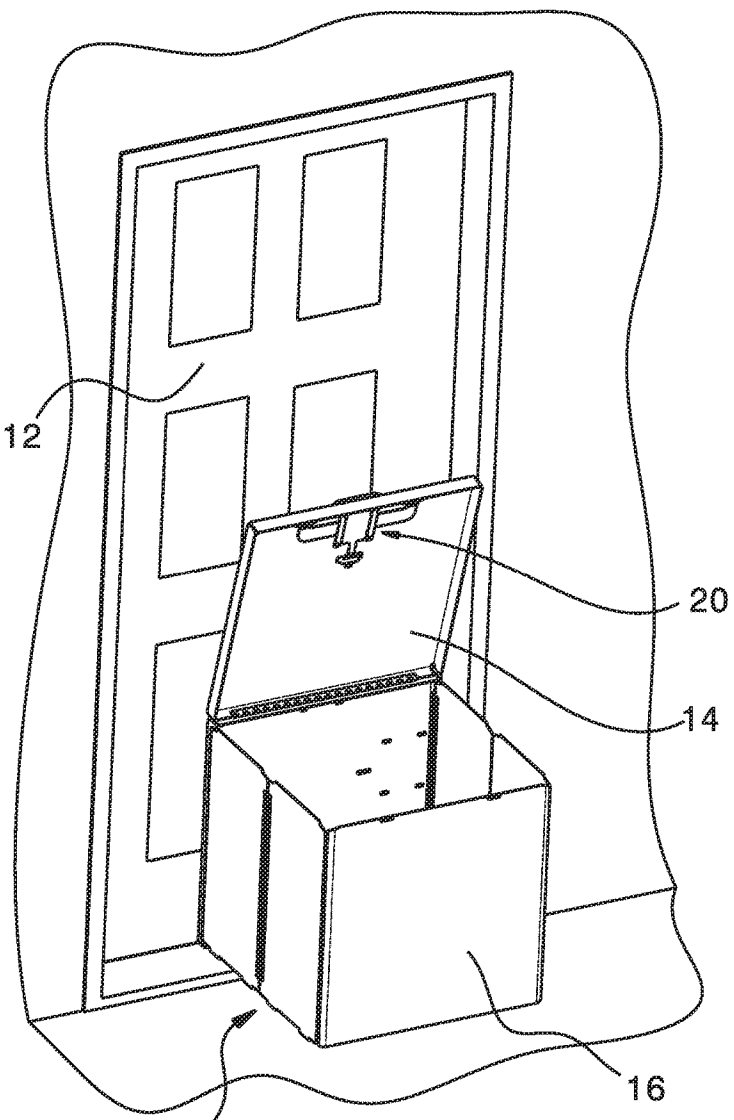
FIG. 2 is another perspective view of the example collapsible drop box in an open condition.
Figure 1:
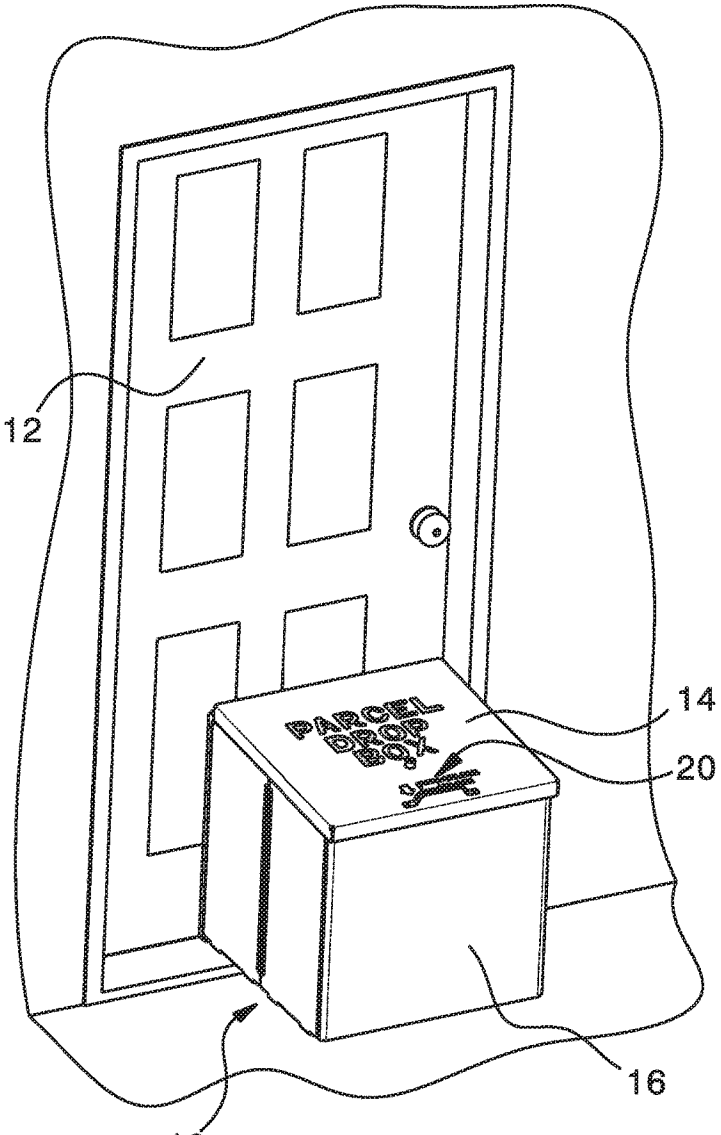
FIG. 1 is a perspective view of an example collapsible drop box embodiment.
Figure 4:
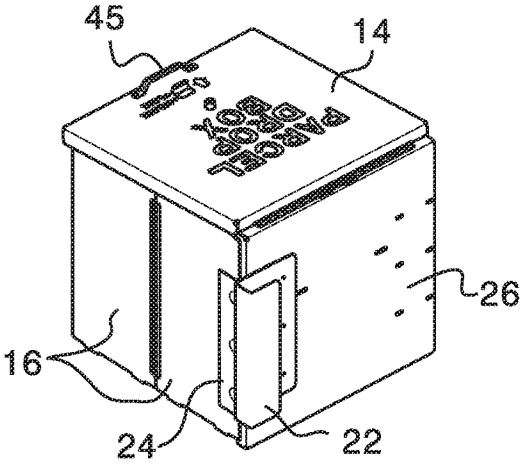
FIG. 4 is a perspective view of a back side of the example collapsible drop box.
Figure 6:
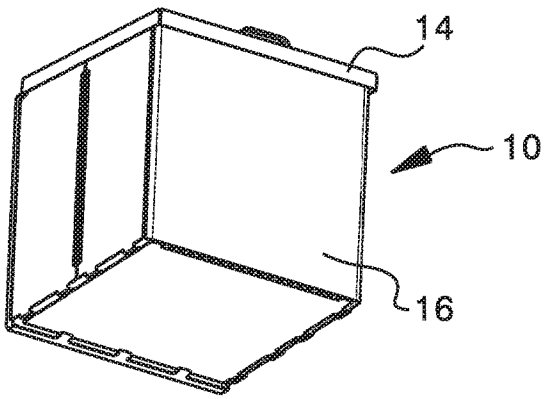
FIG. 6 is a perspective view of a bottom side of the example collapsible drop box.
Figure 3:
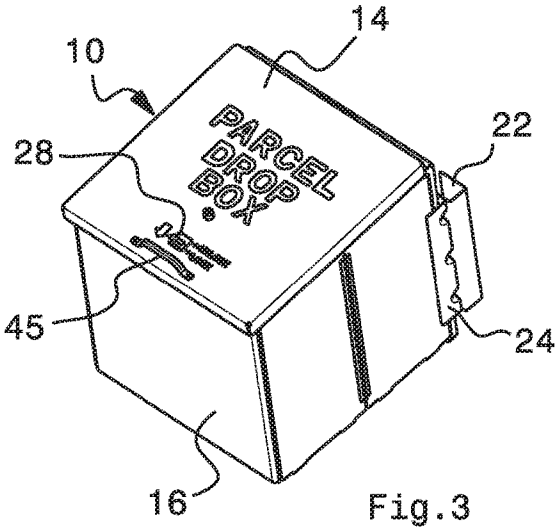
FIG. 3 is perspective view of one side of the example collapsible drop box.
Figure 5:
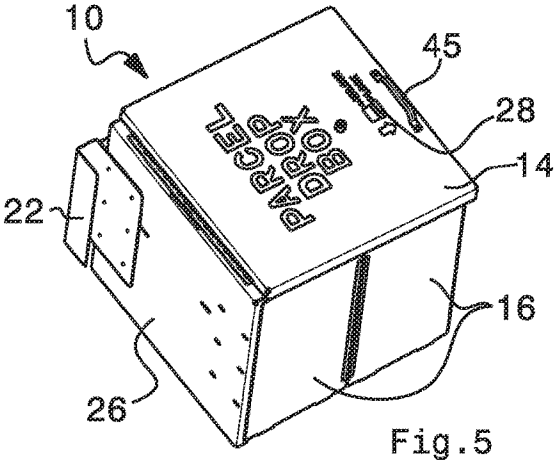
FIG. 5 is a perspective view of a top side of the example collapsible drop box.

Referring to FIGS. 1 and 2, an example parcel drop box embodiment is generally indicated at 10 and includes a lid 14 that shuts over an inner space defined by panels 16. The parcel drop box 10 is temporarily attached and secured to a door 12. The parcel box 10 provides a space for packages to be inserted and then secured by a lock assembly 20 on the lid 14. The lock assembly 20 allows opening of the lid 14 and subsequent locking to secure the lid 14 over the space defined by the panels 16. The lock assembly 20 is configured such that once it is moved to a locked position it may only be reopened with a key.

Referring to FIGS. 3, 4, 5 and 6 with continued reference to FIGS. 1 and 2, the example drop box 10 is temporarily attached to a door 12 utilizing a door bracket 22 and an anti-rotation bracket 24. The door bracket 22 and anti-rotation bracket 24 are attached to a back panel 26 of the drop box 10. The back panel 26 is attached to the side panels 16. In this example, the side panels 16 are formed from a solid sheet metal panel material and define the inner space for a parcel. It should be appreciated that although sheet metal panels are shown by way of this disclosed example, the side panels 16 may be formed from a wire mesh material or other materials. The example parcel drop box 10 is collapsible into a smaller assembly such that it may be moved and stored when not in use. The lid 14 includes a handle 45 and a tab 28 for locking the lid 14.

Figure 7:
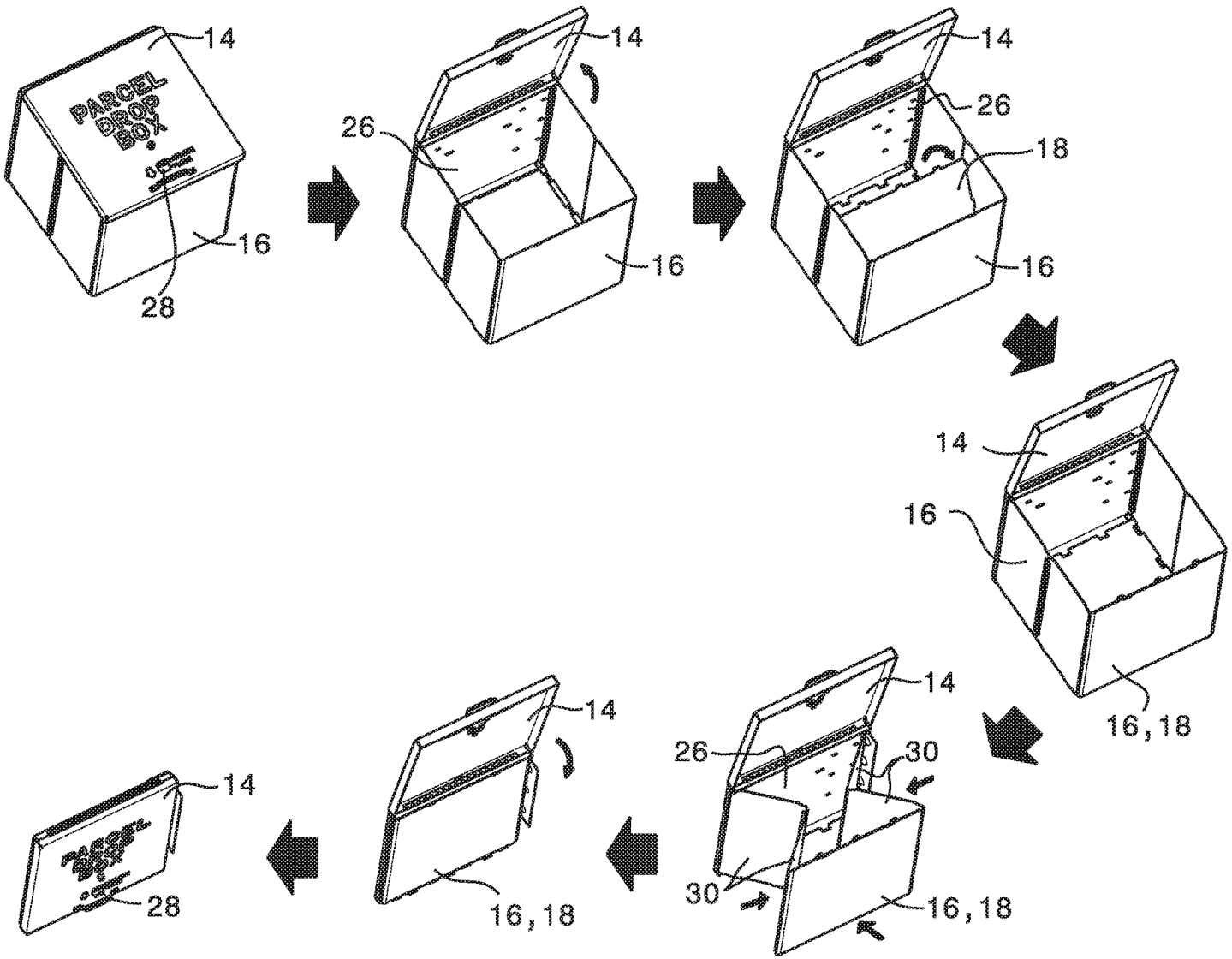
FIG. 7 is a schematic view of steps to collapsing the example drop box to a stowed condition.
Figure 10:
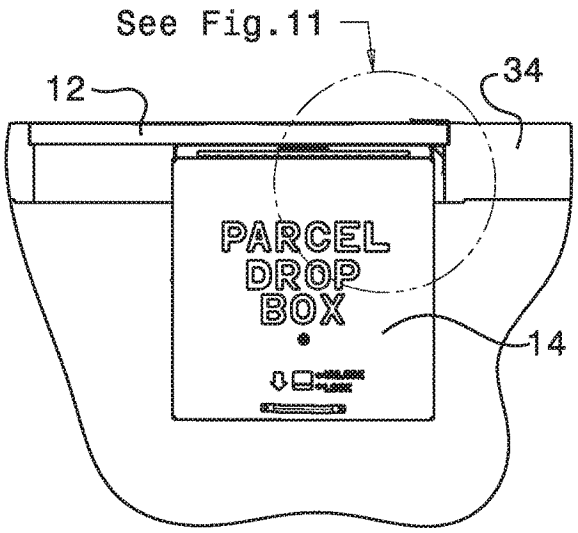
FIG. 10 is a top view of the collapsible drop box secured to the door.
Figure 9:
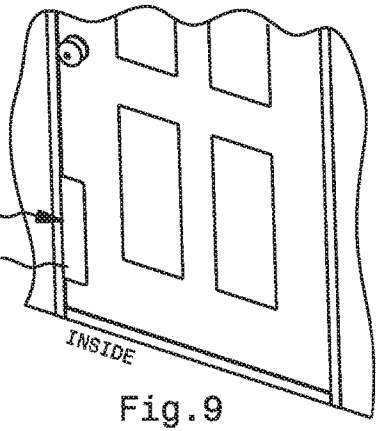
FIG. 9 is a perspective view of an inside of the door with the example door bracket.
Figure 8:
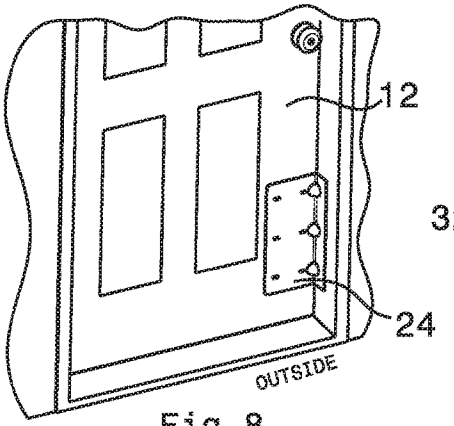
FIG. 8 is a perspective view of an exterior door with an example door bracket.

Referring to FIG. 7, the example parcel box 10 is collapsible into a smaller package for transport and storage. The side panels 16 include hinges such that they may be collapsed in on themselves.

Figures 14, 15, 16, 17, 18:
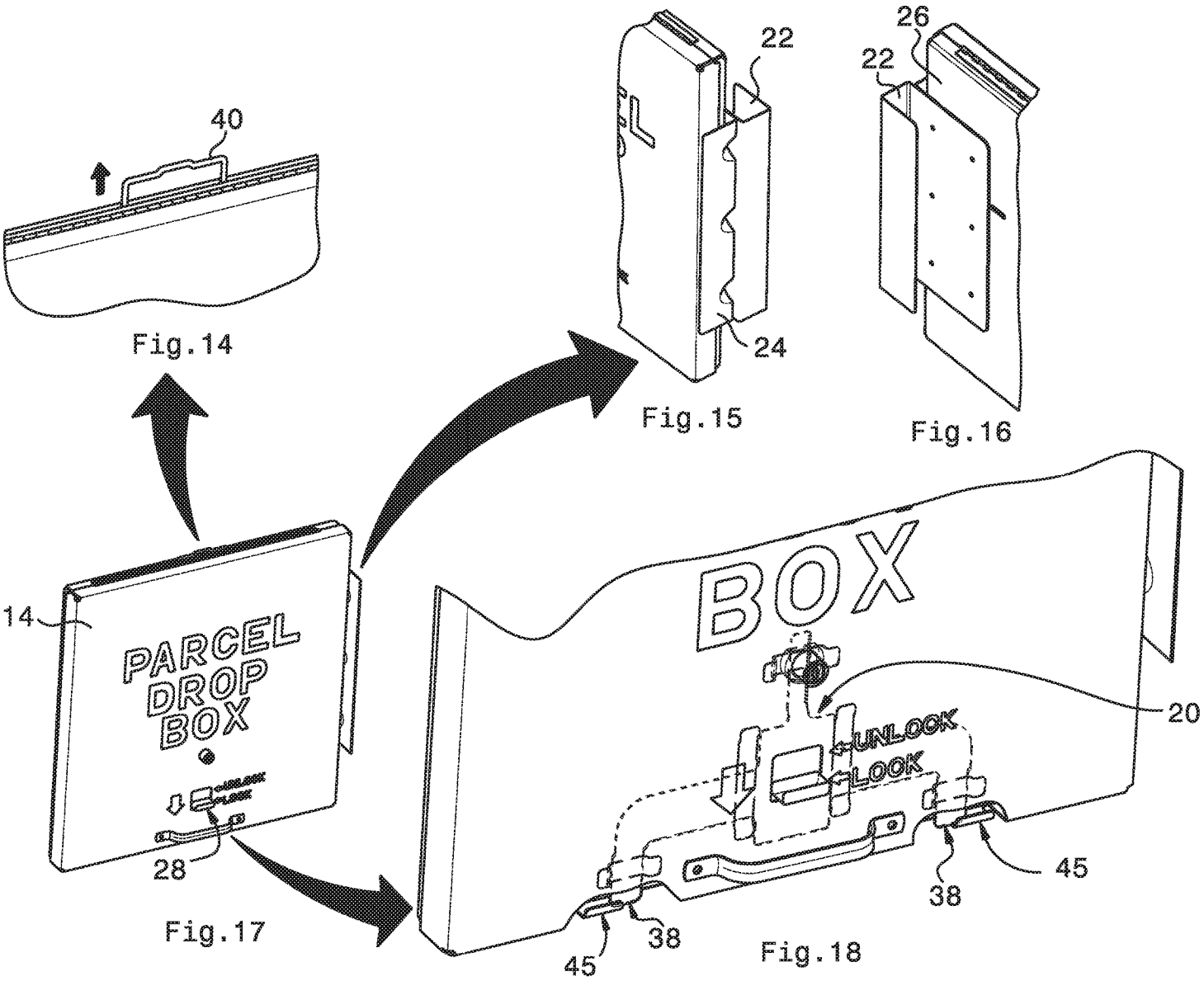
FIG. 14 is an enlarged view of a carrying handle of the collapsible drop box.
FIG. 15 is a side view of the example collapsible drop box in the collapsed condition.
FIG. 16 is a back view of the example collapsible drop box in the collapsed condition.
FIG. 17 is a front view of the example collapsible drop box in the collapsed condition.
FIG. 18 is an enlarged view of an example lock holding the collapsible drop box in the collapsed condition.

FIG. 7 illustrates a sequence of steps required for collapsing the parcel box 10. In this sequence, first the lid 14 is lifted upward and a bottom panel 18 is lifted upward against one of the side panels 16. The side panels 16 include sides and a front portion that is substantially solid. In this example, the bottom panel 18 is pulled upward against the front portion indicated at 16, 18. The side walls include collapsible portions 30 that may then be collapsed on themselves to allow the bottom panel 18 and front panel 16 to be collapsed towards a back panel 26. Once the back panel 26 and the side collapsible portions 30 are moved against the back panel 26, the lid 14 may be moved downwardly over the side panels and then locked in position to a tab of the back panel 26 to hold the assembly in the collapsed position as illustrated in FIG. 17. Because the example parcel box 10 is collapsible on itself, it can be easily brought out and assembled to the door 12 when a package is expected. When a package is not expected, the parcel box can be stored in a small-out-of-the-way space.

Figure 11:
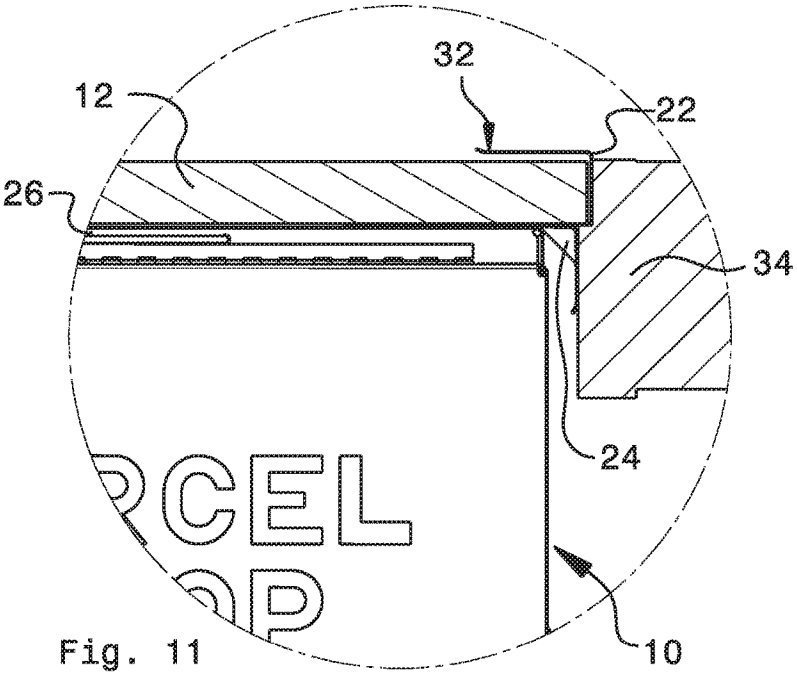
FIG. 11 is an enlarged view of an example door bracket and anti-rotation bracket secured to a door.

Referring to FIGS. 8, 9, 10 and 11, the example parcel drop box 10 includes features to prevent removal or damage by rocking or otherwise twisting the drop box 10 when it is assembled to the door 12. An anti-rotation bracket 24 is provided and attached to the door bracket 22. The door bracket 22 extends from an outside portion of the door through a seam between the door and the door jamb 34 to a back side indicated at 32. The back side 32 prevents the parcel drop box 10 from being removed from the door 12 unless the door is open. As appreciated, the door 12 is locked and thereby the bracket 22 and parcel box 10 cannot be removed. However, as indicated in FIG. 11, the parcel box 10 may be spaced apart from the door jamb 34 and provide a space where someone may rock the parcel drop box 10 and possibly fatigue and destroy the door bracket 22. The anti-rotation bracket 24 abuts against the door jamb 34 and the door 12 to prevent movement of the parcel drop box 10 that could be utilized to fatigue and destroy the door bracket 22. Accordingly, the anti-rotation bracket 24 and the door bracket 22 combine to provide a temporary, yet substantially tamper resistant securement of the parcel drop box 10 to the door 12.

Figure 12:
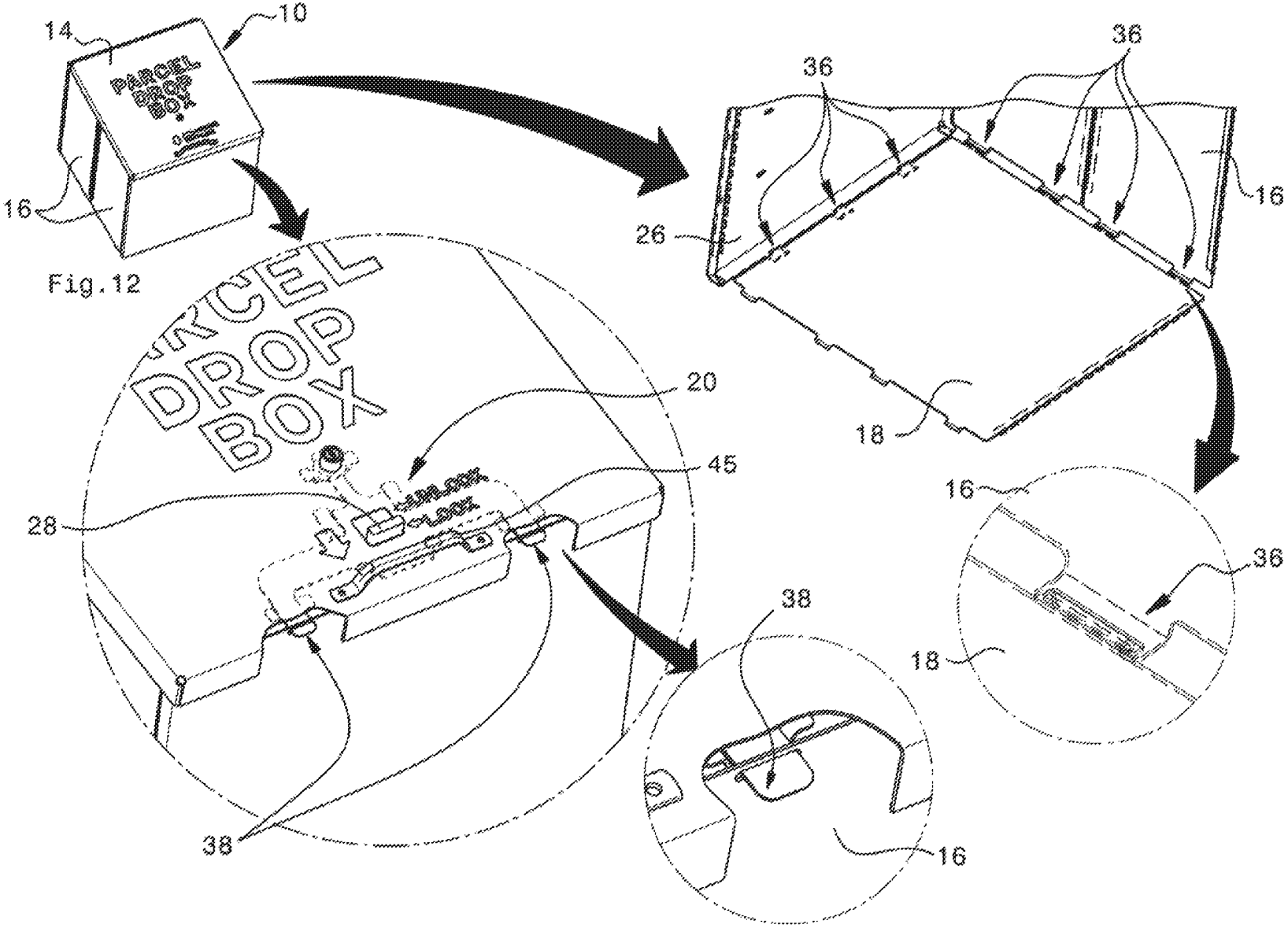
FIG. 12 is a schematic view of example locking tabs for securing the lid and bottom to the collapsible drop box.

Referring to FIG. 12, the example panels 16 and 18 include interlocks 36 that attach to the back panel 26 along with other panels that define the side walls. The interlocks 36 secure the parts together while allowing relative movement to enable collapsing of the drop box 10. Also shown in these views are tabs 38 of the lock assembly 20. Tabs 38 engage the slotted holes on side wall 16 to secure the lid 14 once the tab 28 moved to a locked position.

Figure 13:
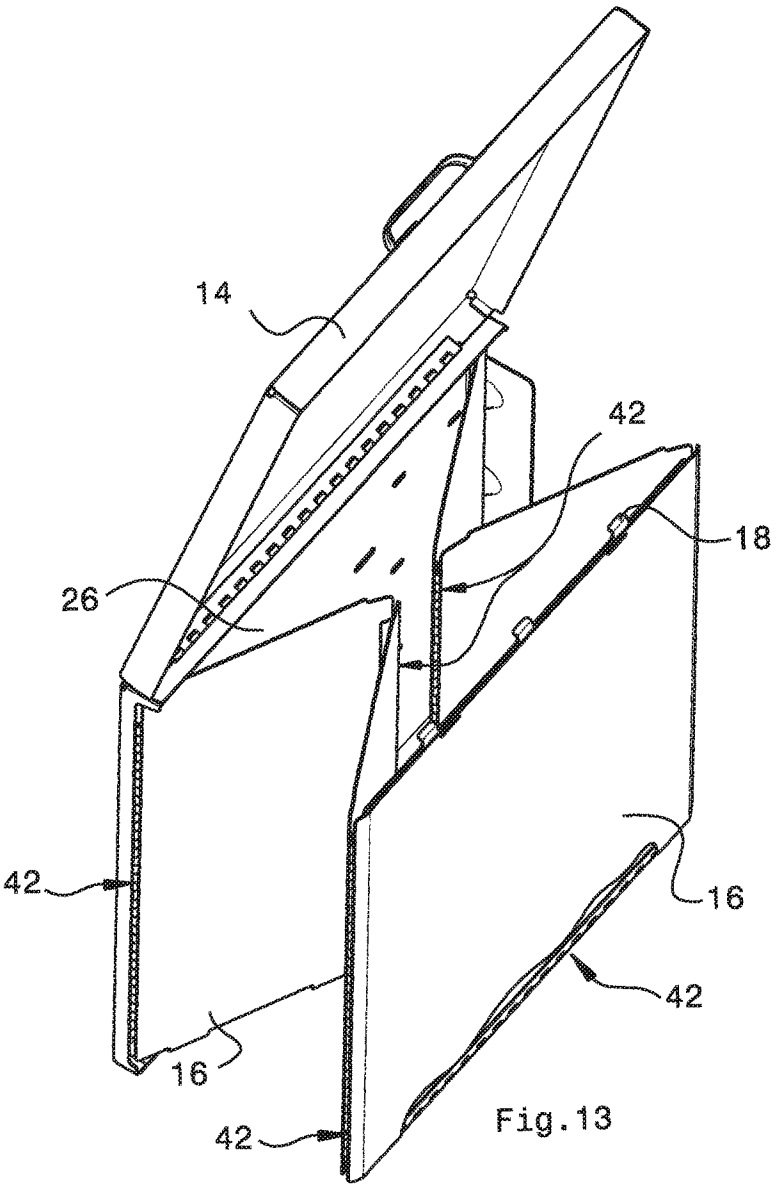
FIG. 13 is a perspective view of the example collapsible drop box in a partially collapsed condition.

Referring to FIG. 13 with continued reference to FIG. 12, hinges 42 are provided at locations of the bottom panel 18 and side panels 16 to enable collapsing of the bottom panel and side panels 16 into back panel 26 and lid 14. In this example, the bottom panel 18 and side panels 16 are fabricated from sheet metal with piano hinges attached to the panels. The hinges 42 provide for collapsing and rotation of the bottom panel 18 and each of the side panels 16 to enable the collapsing configuration illustrated in FIG. 13. As appreciated, the example hinges 42 are just one embodiment of possible hinge configuration that could be utilized to enable collapsing of the side panels 16. Moreover, if the side panels 16 are fabricated from wire mesh, then different hinge assemblies could be utilized and are within contemplation of this disclosure.

Referring to FIGS. 14, 15, 16, 17 and 18, the example parcel box 10 is shown in the collapsed condition and includes a carrying handle 40 that can move upwardly to enable easy carrying of the collapsed parcel box assembly. In a collapsed position, the anti-rotation bracket 24 and door bracket 22 are shown extending outward from the back panel 26. Moreover, in the collapsed position, the lock assembly 20 includes the tabs 38 that are engaged to corresponding tabs 45 that are formed on the back panel 26.

Figure 19:
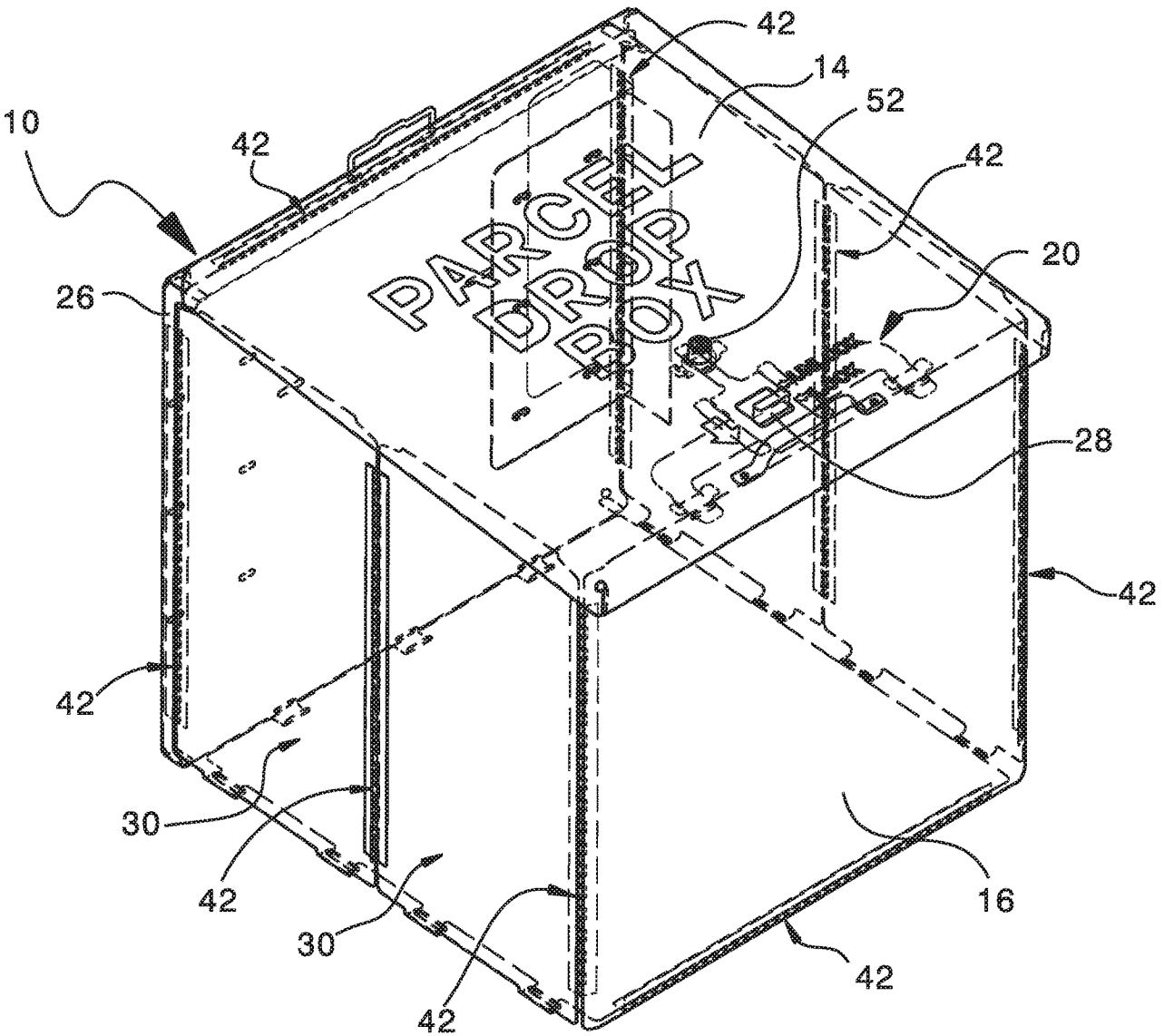
FIG. 19 is a partially transparent view of the example collapsible drop box illustrating example hinge connection that enable collapsing.

Referring to FIG. 19, the example parcel box 10 is illustrated in a perspective view where location of each of the hinges 42 can be seen. In this example, the hinges 42 are disposed on each of the corners and also within the middle section to allow and enable the side portions 30 to collapse inwardly such that the parcel box can be collapsed into the storage position illustrated in FIG. 17.

Figure 20:
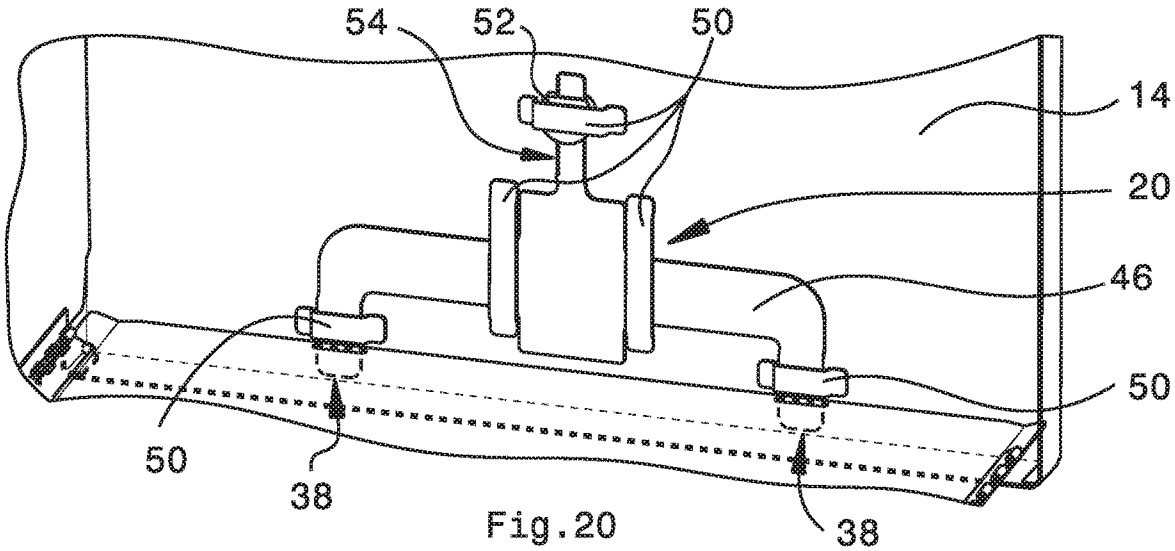
FIG. 20 is a bottom view of the lid including an example lock in a locked position.
Figure 21:
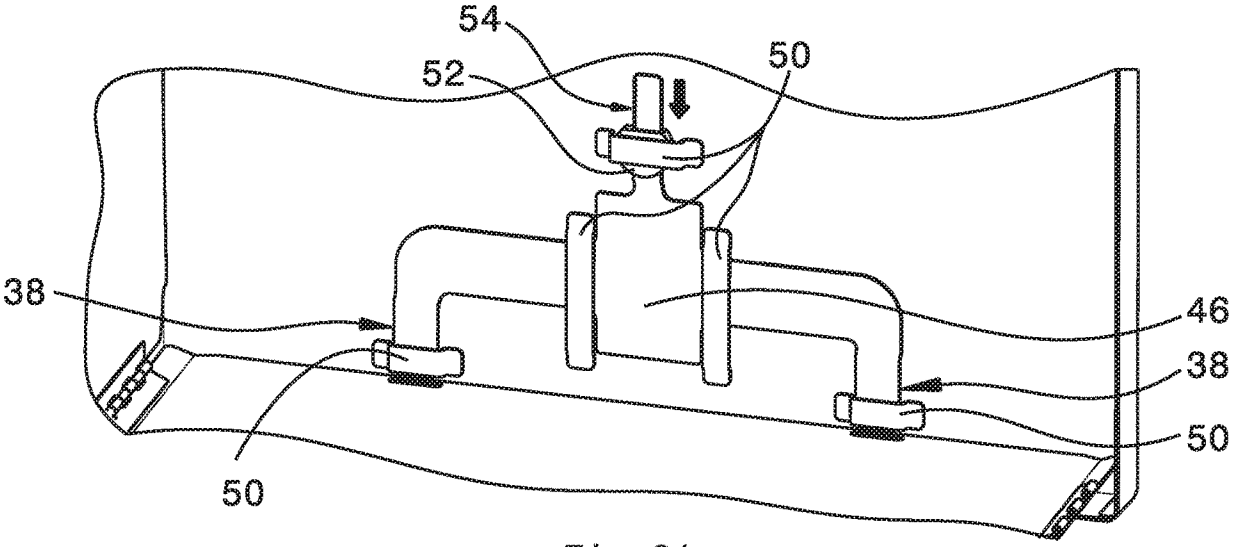
FIG. 21 is a bottom view of the lid including the example lock in an unlocked position.

Referring to FIGS. 20 and 21, the example lock assembly 20 includes a slider 46 that is held onto the lid 14 by brackets 50. The slider 46 includes a ratchet portion 54 that engages a lock 52. The lock 52 extends through the panel 14 and is accessible and unlockable through the use of a key. FIG. 20 illustrates the lock assembly in a locked position. Only use of a key to unlock the lock 52 will enable the slide 46 to move back to an open position. FIG. 21 illustrates the slider 46 in an open position. In the open position, tabs 38 are free of corresponding panels and enable the lid 14 to be opened outwardly. As can be seen, the ratchet portion 54 is extended through the lock 52. The lock 52 is arranged such that it enables movement of the slide 46 by use of the ratchet portion 54 in one direction. The direction is indicated by the arrow in FIG. 21. Movement in this direction is facilitated by a tab 28 that is accessible through the top side of the lid 14. Once the slider 46 is moved to the locked position illustrated in FIG. 20, only unlocking of the lock 52 will enable the slider to move back to the open position shown in FIG. 21.

In use, the lock assembly 20 is left in an unlocked position until a delivery person inserts a package. Once a delivery person inserts a package into the drop box assembly 10, the delivery person will move the tab on the outer portion of the lid to the locked position. Once the lock assembly 20 is moved to the locked position it may not be moved to the unlocked position again. Accordingly, the example drop box provides an easy means for a delivery person to place the package in a secure environment without the need to have special access codes, devices or keys.

Figure 22:
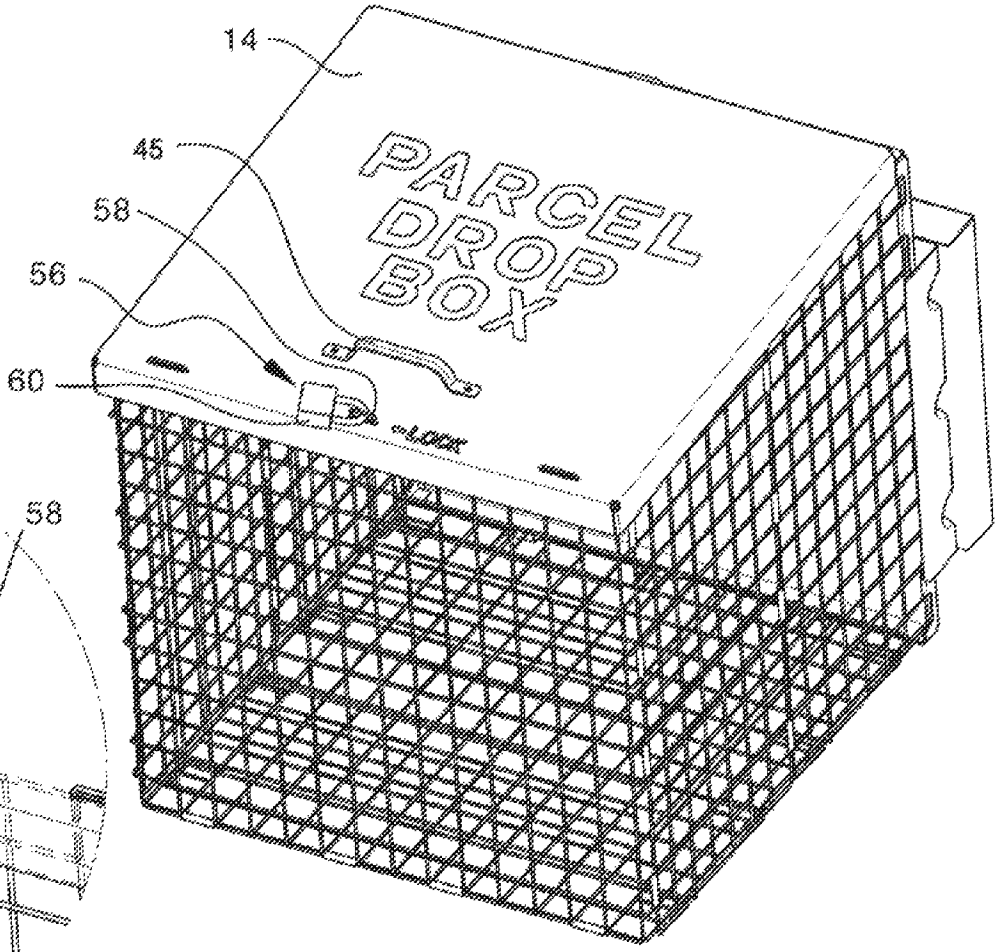
FIG. 22 is another example collapsible drop box embodiment.
Figure 23:
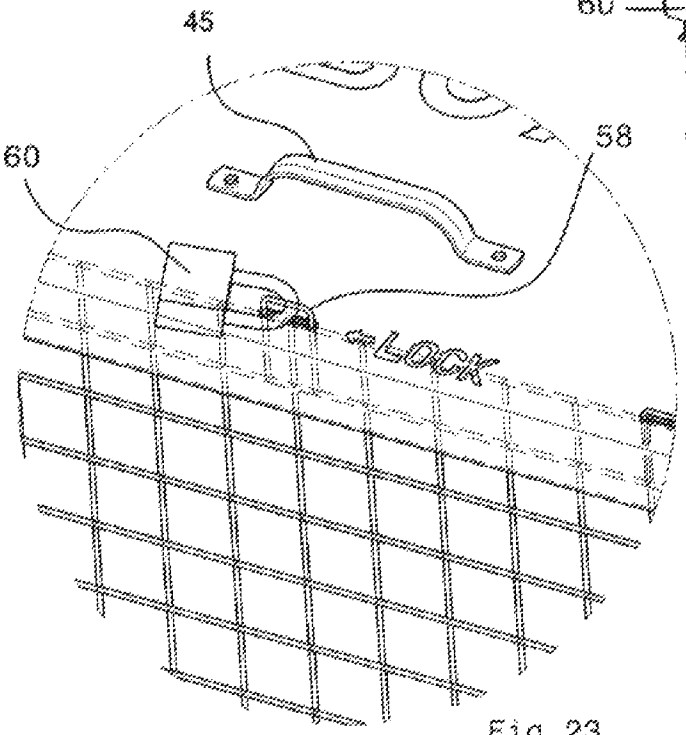
FIG. 23 is an enlarged view of a lock assembly of the collapsible drop box embodiment.
Figure 26:
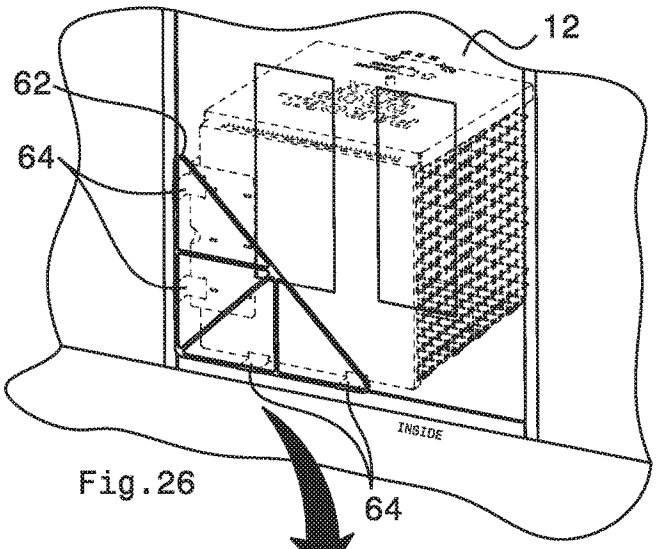
FIG. 26 is a perspective view of the example door bracket secured to the inside of the door.
Figure 27:
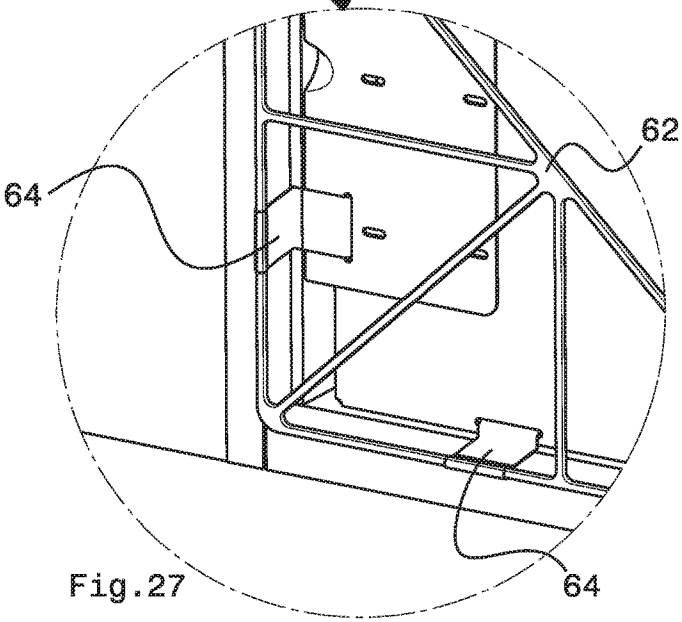
FIG. 27 is an enlarged view of the example door bracket from the interior side of the door.
Figure 24:
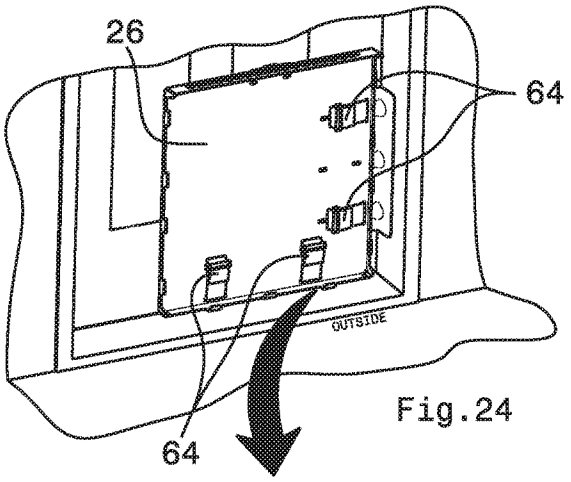
FIG. 24 is a perspective view of another example door bracket secured to an outside of a door without the collapsible drop box.
Figure 25:
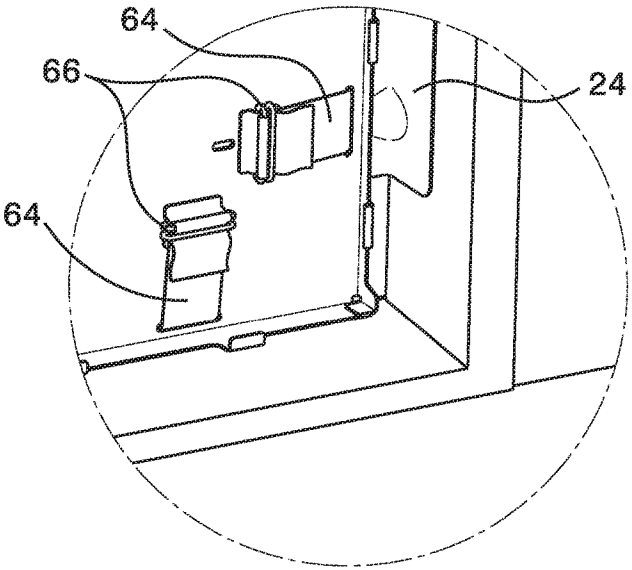
FIG. 25 is an enlarged view of the example door bracket secured to the outside of the door.

Referring to FIGS. 22 and 23, another lock configuration 56 may be utilized with the example parcel box. In this example, side panels 16 and bottom panel 18 are formed from wire mesh material, a simple loop 58 extends from side panel 16 through the lid 14 and a common lock 60 is utilized. In this example, the lock 60 is a common key lock, but other locks could also be utilized such as combination or electronically operated locks and are within the contemplation of this disclosure. The lock 60 can be left in an open position until a delivery person inserts a package into the parcel drop box 10. Once a delivery person places the parcel in the drop box, the lock 60 can be locked and then unauthorized persons without a key may not access the drop box without destroying the drop box.

Referring to FIGS. 24, 25, 26 and 27, an alternate temporary securement bracket is illustrated and includes an inside retainer 62 disposed on an inside portion of the door 12. The retainer 62 is substantially triangular and extends between a side and a bottom portion of the door 12 to provide a securing anchoring feature for the back panel 26. Straps 64 extend through seams on the bottom and side of the door 12 and are attached to the retainer 62. Straps extend through the seams between the bottom and sides of the door to the back panel 26 and are secured there by buckle 66. This example provides a collapsible structure that enables for a smaller package when the parcel box 10 is collapsed for storage. In this example, the anti-rotation bracket 24 is maintained and is attached to the panel 26 to prevent rotation of the parcel box that could be utilized to dislodge the parcel box from the door 12.

Figure 29:
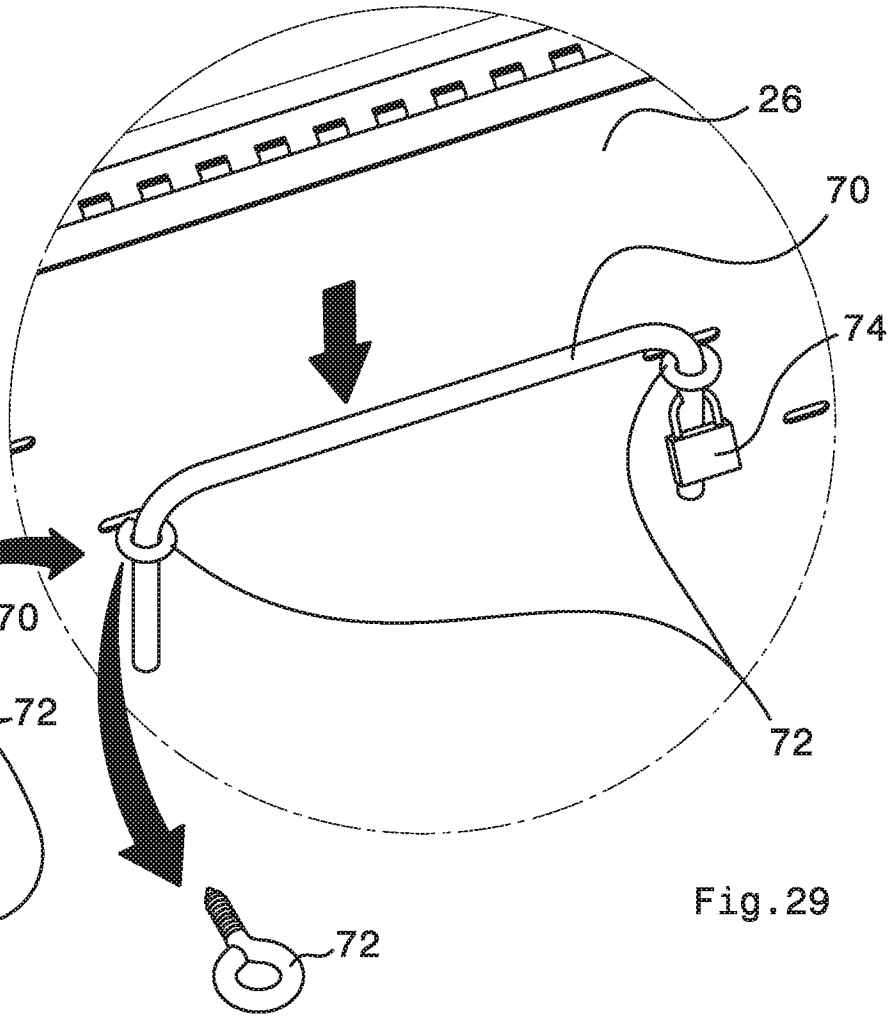
FIG. 29 is an enlarged view of the securement means shown in FIG. 28.
Figure 28:
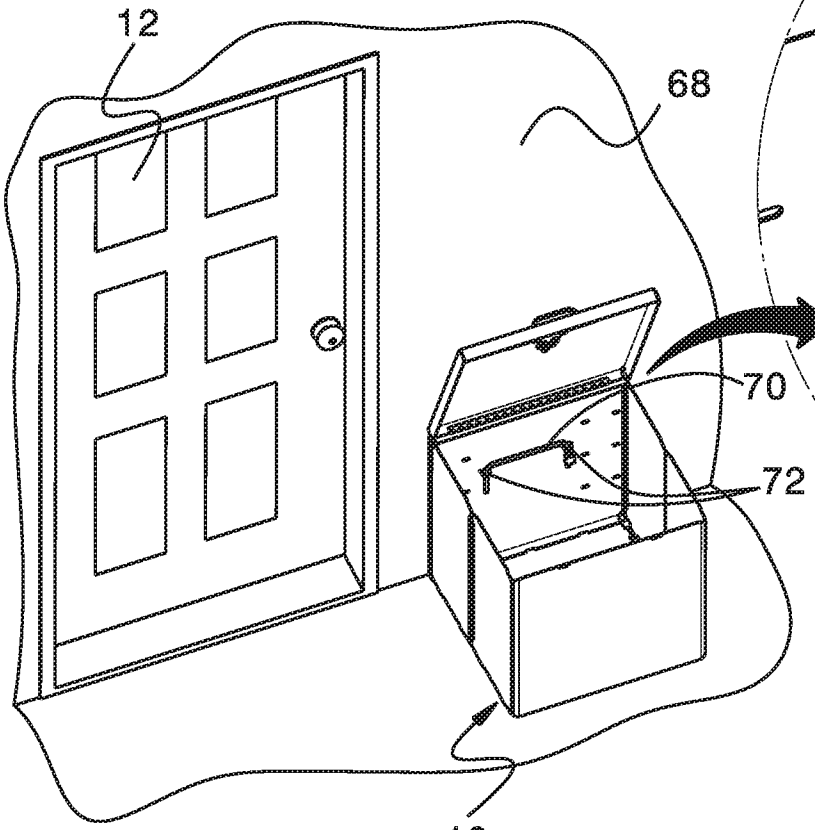
FIG. 28 is a perspective view of another securement means for securing the collapsible drop box.
Figure 32:
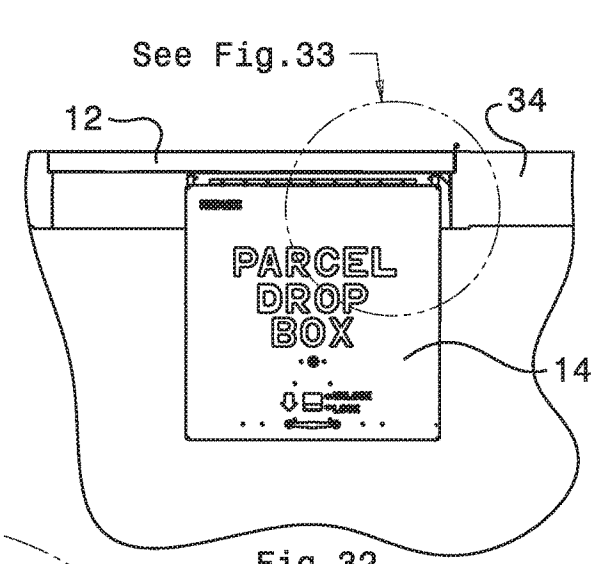
FIG. 32 is a top view of the example door bracket.
Figure 31:
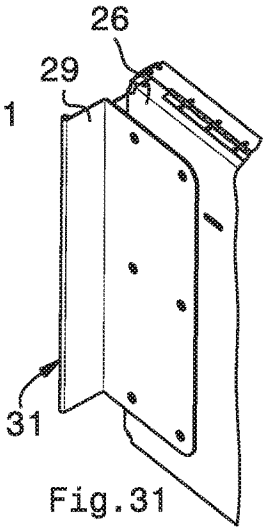
FIG. 31 is a perspective view of the example door bracket secured to a back of the collapsible drop box.
Figure 30:
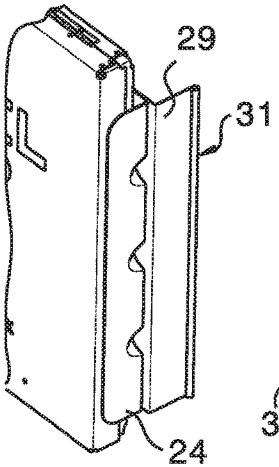
FIG. 30 is a perspective view of another door bracket and anti-rotation bracket.
Figure 33:
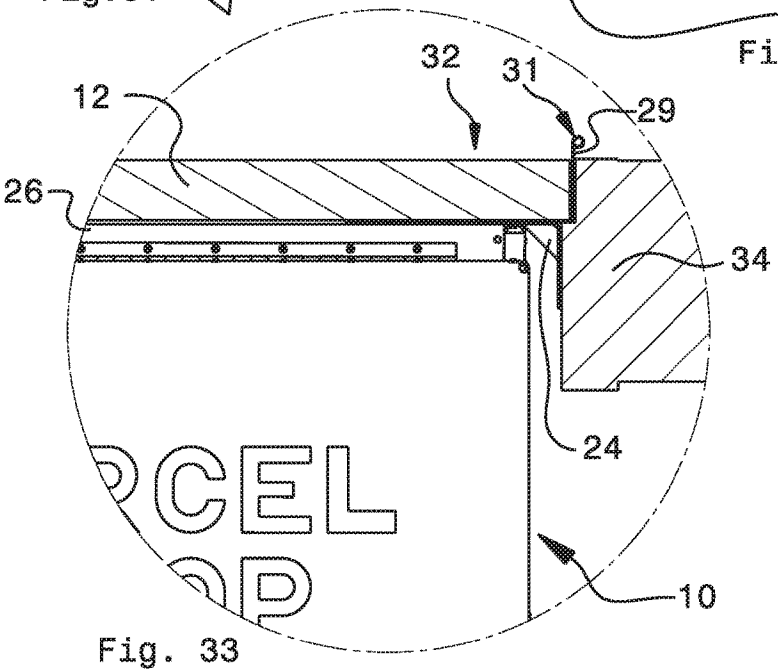
FIG. 33 is an enlarged view of the example door bracket secured to the door and the collapsible drop box.

Referring to FIGS. 28 and 29, an alternate securement means is shown schematically and includes a lock bar 70 that is inserted into eyelets of eyebolts 72. In this example, the parcel box 10 is secured to a wall 68 that is near the door 12. The wall 68 includes eyelets 72 that correspond with slots within the parcel box 10. The parcel box 10 is slid up against the wall such that eyelets extend through slots in the back panel 26. The lock bar 70 is then inserted into the eyelets 72 to block removal of the parcel box from the eyelets.

Referring to FIG. 29, a lock 74 can be installed through a hole on the lock bar 70 to prevent removal of the parcel box from the wall 68 and the eyelet 72 when lid 14 is in unlocked position.

Referring to FIGS. 30, 31, 32 and 33 the disclosed lock box 10 is shown secured to the door with an alternate door bracket 29. The door bracket 29 includes a stop end 31 that provides an increased thickness that cannot be pulled through the gap between the door 12 and the door frame 34. In the disclosed example, the stop end 31 is rolled to provide an increased width that cannot be pulled through the gap between the door 12 and the door frame 34. However, it should be appreciated, that the stop end 31 can be any shape that prevents the bracket 29 from being pulled through the gap between the door 12 and the door frame 34. The stop end 31 provides an alternate means of securement to the door that can ease installation and removal once the parcel is received. The example door bracket 29 works with the anti-rotation bracket 24 as disclosed and described above.

Figure 34:
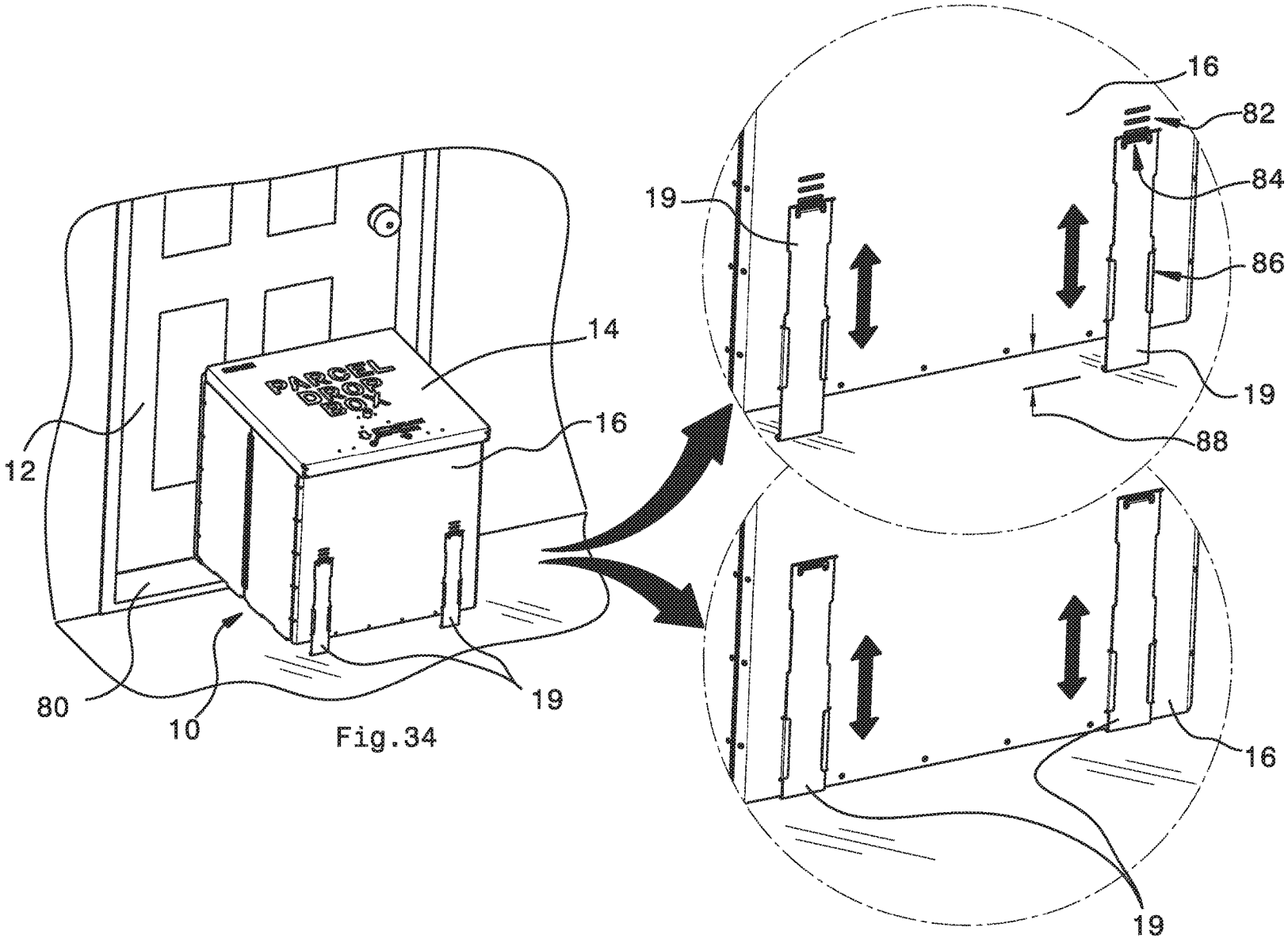
FIG. 34 is a schematic view of levelers of the example collapsible drop box.

Referring to FIG. 34, the example lock box 10 includes levelers 19 that can be extended downward to level the box to accommodate door thresholds 80 of different thickness. The levelers 19 are supported by tabs 86 and are slidable relative to the box 10. The levelers 19 are provided to raise one side of the lock box 10 a height 88. The height 88 corresponds with a thickness of the threshold 80 to level the box 10. Slots 82 are disposed near the top of each of the levelers 19 and are provided at preset spacing to accommodate differing door thresholds 80. The levelers 19 includes a stop 84 that fits into one of the slots 82 to hold the leveler 19 in place and thereby the front of the lock box 10 at a level position.

Figure 35:
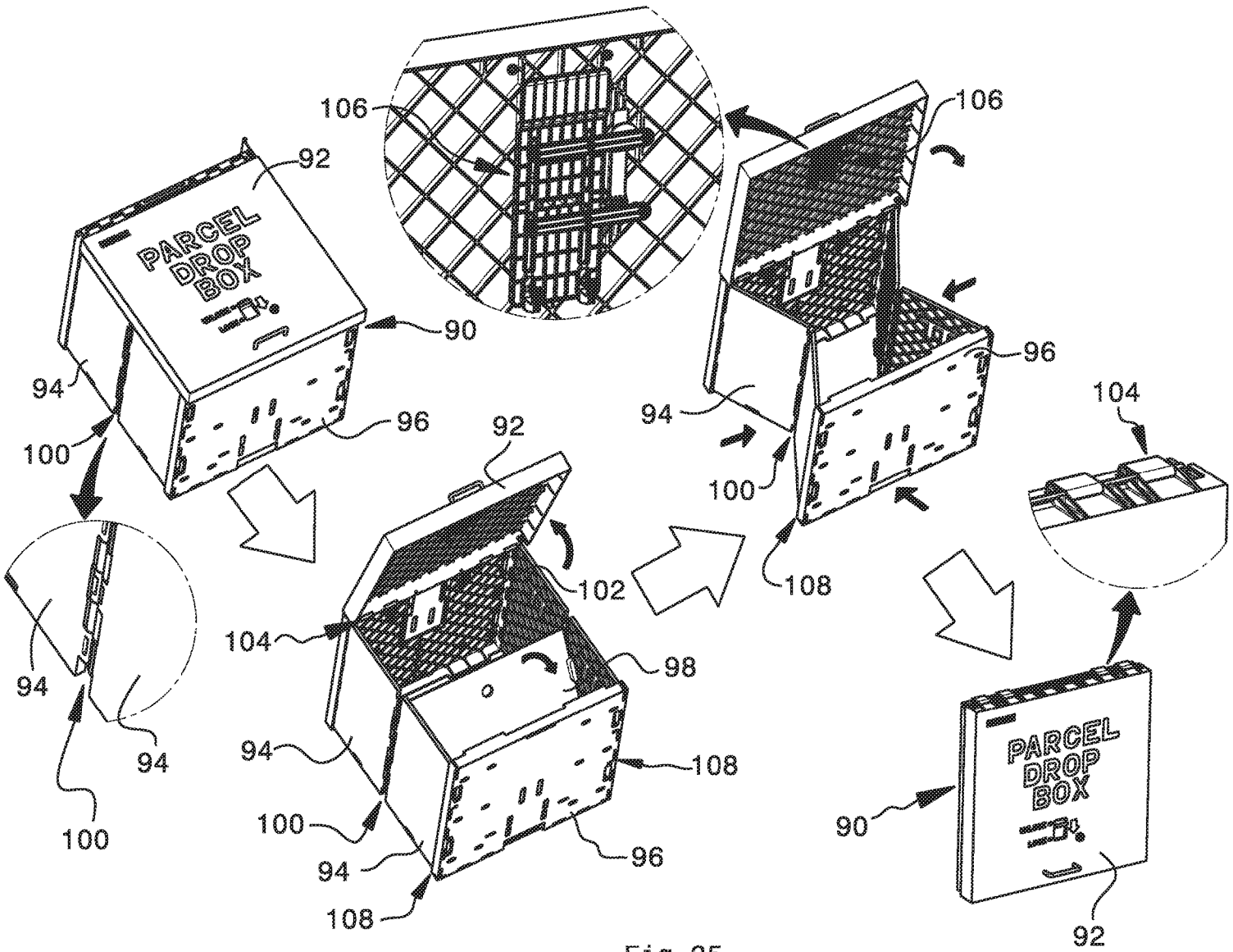
FIG. 35 is a schematic view of another collapsible drop box embodiment constructed of plastic material illustrating stages of collapsing to the collapsed condition.

Referring to FIG. 35 another lock box 90 is shown and is constructed of plastic panels. The box 90 includes side panels 94, front 96, bottom 98, back 102 and lid 92 all connected by hinges to enable folding for storage. The side panels 94 are connected by hinge 100. The lid 92 is attached to the back panel 102 by hinge 104. The bottom 98 may be connected to the front 96 by a hinge. The bottom 98 may also be free and simply be moveable to a position that enables folding into the stowed position. The front panel 96 is attached to the side panels 94 by front hinges 108. The lid 92 includes a sliding lock 106 to prevent unauthorized access to the interior compartment once a package is delivered.

The example parcel box provides a collapsible temporary secure storage space that enables a delivery person to insert packages and lock the box without the consumer needing to attend the parcel box. Furthermore, the parcel box is collapsible such that it can be utilized only when needed and stored in a convenient manner when not necessary or required. Moreover, the parcel box provides easy securement to an exterior door such that it can be utilized in any application or location.

Although a preferred embodiment has been disclosed, a worker of ordinary skill in this art would recognize that certain modifications would come within the scope of this disclosure. For that reason, the following claims should be studied to determine the true scope and content of this disclosure.

What is claimed is:

1. A parcel drop box comprising:

a plurality of side panels defining an interior space;

a back panel secured to the side panels;

a lid movable between open and closed positions over the interior space;

a lock assembly disposed on the lid moveable to a locked position preventing opening of the lid, wherein the lock assembly includes a slider and a ratchet portion in communication with a lock, the ratchet portion allowing movement of the slider from an unlocked position to the locked position without unlocking the lock and prevents movement of the slider from the locked position to the unlocked position;

a bracket temporarily securing the parcel drop box to a fixed structure; and an anti-rotation bracket maintaining a fixed position of the drop box relative to the fixed structure.

2. The parcel drop box as recited in claim 1, wherein the side panels are collapsible against the back panel to place the drop box in a transport and storage configuration.

3. The parcel drop box as recited in claim 1, wherein the bracket comprises a C-shape configured to wrap around a door and the anti-rotation bracket is configured to abut a door frame.

* * * * *